US006471471B1

(12) United States Patent
Bouyer

(10) Patent No.: US 6,471,471 B1
(45) Date of Patent: Oct. 29, 2002

(54) METHODS AND APPARATUS FOR ADJUSTING GAS TURBINE ENGINE VARIABLE VANES

(75) Inventor: Mark Jeffery Bouyer, Reading, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/826,107

(22) Filed: Apr. 4, 2001

(51) Int. Cl.[7] ..... F01D 17/16
(52) U.S. Cl. ..... 415/160; 415/1
(58) Field of Search ..... 415/159, 160, 415/191, 208.2, 199.5, 1

(56) References Cited

U.S. PATENT DOCUMENTS 3,314,595 A * 4/1967 Burge et al. ..... 415/160
3,376,018 A * 4/1968 Williamson ..... 415/149.4
3,873,230 A * 3/1975 Norris et al. ..... 415/149.4
4,292,802 A 10/1981 Snow
5,054,997 A 10/1991 Corsmeier et al.
5,307,624 A 5/1994 Even-Nur et al.
5,437,411 A 8/1995 Renggli

* cited by examiner

*Primary Examiner*—Edward K. Look
*Assistant Examiner*—Richard A. Edgar
(74) *Attorney, Agent, or Firm*—William Scott Andes; Armstrong Teasdale LLP

(57) ABSTRACT

A gas turbine engine including a variable geometry system that includes a mounting system to facilitate extending a useful life of a variable geometry system is described. The engine includes a high pressure compressor including a plurality of variable vanes and rotating vanes. The variable geometry system is coupled to an actuator and includes a master lever, an aft mount, and a slot and groove joint. The master lever is coupled to the aft mount with the slot and groove joint, and adjusts a position of the variable vanes without inducing angular displacement on the aft mount.

18 Claims, 3 Drawing Sheets

METHODS AND APPARATUS FOR ADJUSTING GAS TURBINE ENGINE VARIABLE VANES

BACKGROUND OF THE INVENTION

This invention relates generally to gas turbine engine variable vanes and, more particularly, to variable geometry systems used to position gas turbine engine variable vanes.

At least some known gas turbine engines include a constant volume high pressure compressor including a plurality of stationary vanes, a plurality of rotating airfoils, and a variable geometry system. The variable geometry system adjusts a position of the stationary vanes relative to a compressor flowpath. More specifically, the variable geometry system positions the variable vanes such that air flowing through the stationary vanes is re-directed towards the rotating airfoils. Re-directing the airflow facilitates improving turbine performance while maintaining aerodynamic loading within mechanical limits of the airfoils. Additionally, variable vanes facilitate the gas turbine engine to achieve efficiency and stall margin requirements.

Known variable geometry systems include an outer bellcrank, an inner bellcrank, an actuator, a master lever, a plurality of links, and an aft mount. The actuator is coupled to the outer bellcrank and positions the outer bellcrank to schedule the variable vanes. The inner bellcrank is coupled to the outer bellcrank and thus rotates proportionally with the outer bellcrank. The master lever is coupled between the inner bellcrank and the aft mount with a spherical bearing, and the links are coupled between the master lever and the variable vanes. The aft mount is coupled to the engine with at least two spherical bearings, and to the master lever with an additional bearing.

During operation of the variable geometry system, the outer bellcrank rotates and translates linear motion induced by the actuator to an angular displacement. The inner bellcrank rotates proportionally with the outer bellcrank and translates the angular displacement to linear displacements at the master lever and the links. As the inner bellcrank rotates, the master lever shifts, and a distance between a trailing edge of the master lever and the inner bellcrank is reduced. Because the aft mount is coupled to the master lever trailing edge with a spherical bearing, and because the aft mount is coupled to the engine with at least two spherical bearings, as the master lever shifts, an angular displacement is induced on the aft mount.

Over time, continued activation of the variable geometry system may induce high stresses on the aft mount bearings. More specifically, continued activation of the variable geometry system may cause excessive wear to occur between the aft mount bearing and the master lever, and between the aft mount and the engine.

BRIEF SUMMARY OF THE INVENTION

In an exemplary embodiment, a gas turbine engine includes a variable geometry system aft mount that facilitates extending a useful life of the variable geometry system. The engine includes a high pressure compressor including a plurality of variable vanes and rotating vanes or airfoils. The variable geometry system is coupled to an actuator and includes a master lever, an aft mount, and a slot and groove joint. The master lever is coupled to the aft mount system with the slot and groove joint, and is configured to adjust a position of the variable vanes.

During activation of the variable geometry system, the master lever responds to movement of the actuator. As the master lever shifts forward in response to the actuator movement, the slot and groove joint restricts the movement of the master lever to two-dimensional planar movement and eliminates angular displacement stresses induced on the aft mount. Because the aft mount is prevented from being angularly displaced, the aft mount is fixedly attached to the gas turbine engine without the use of spherical bearings. Furthermore, the slot and groove joint facilitates the reduction of wear between the aft mount and the master lever.

DETAILED DESCRIPTION OF THE INVENTION

Figure 1:
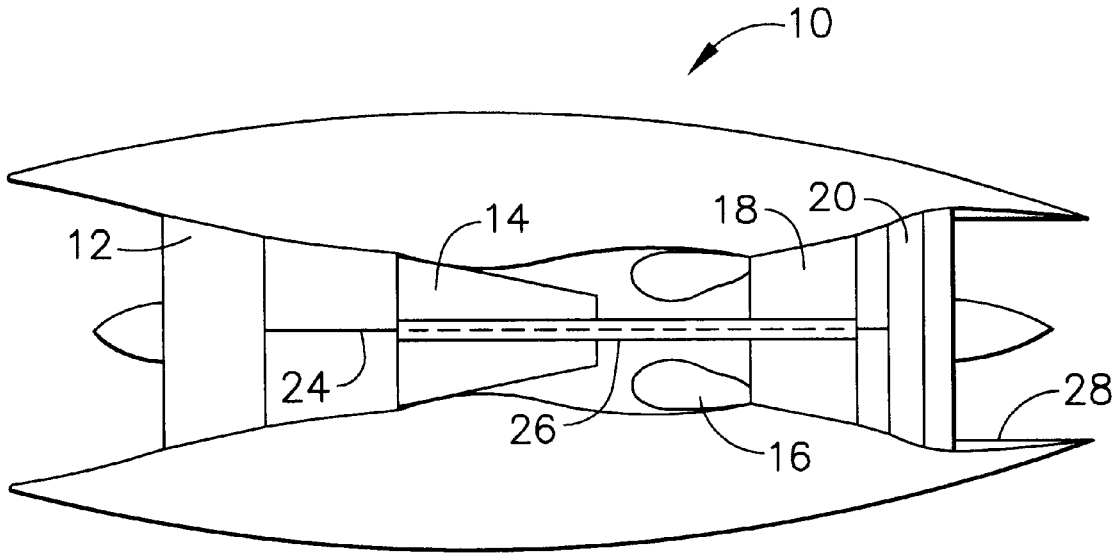
FIG. 1 is a schematic illustration of a gas turbine engine.

FIG. 1 is a schematic illustration of a gas turbine engine 10 including a low pressure compressor 12, a high pressure compressor 14, and a combustor 16. In one embodiment, engine 10 is a F404 engine commercially available from General Electric Company, Cincinnati, Ohio. Engine 10 also includes a high pressure turbine 18 and a low pressure turbine 20. Compressor 14 is a constant volume compressor and includes a plurality of variable vanes (not shown in FIG. 1) and a plurality of stationary vanes (not shown). Compressor 12 and turbine 20 are coupled by a first shaft 24, and compressor 14 and turbine 18 are coupled by a second shaft 26.

In operation, air flows through low pressure compressor 12 and compressed air is supplied from low pressure compressor 12 to high pressure compressor 14. The highly compressed air is delivered to combustor 16. Airflow from combustor 16 drives rotating turbines 18 and 20 and exits gas turbine engine 10 through a nozzle 28.

Figure 2:
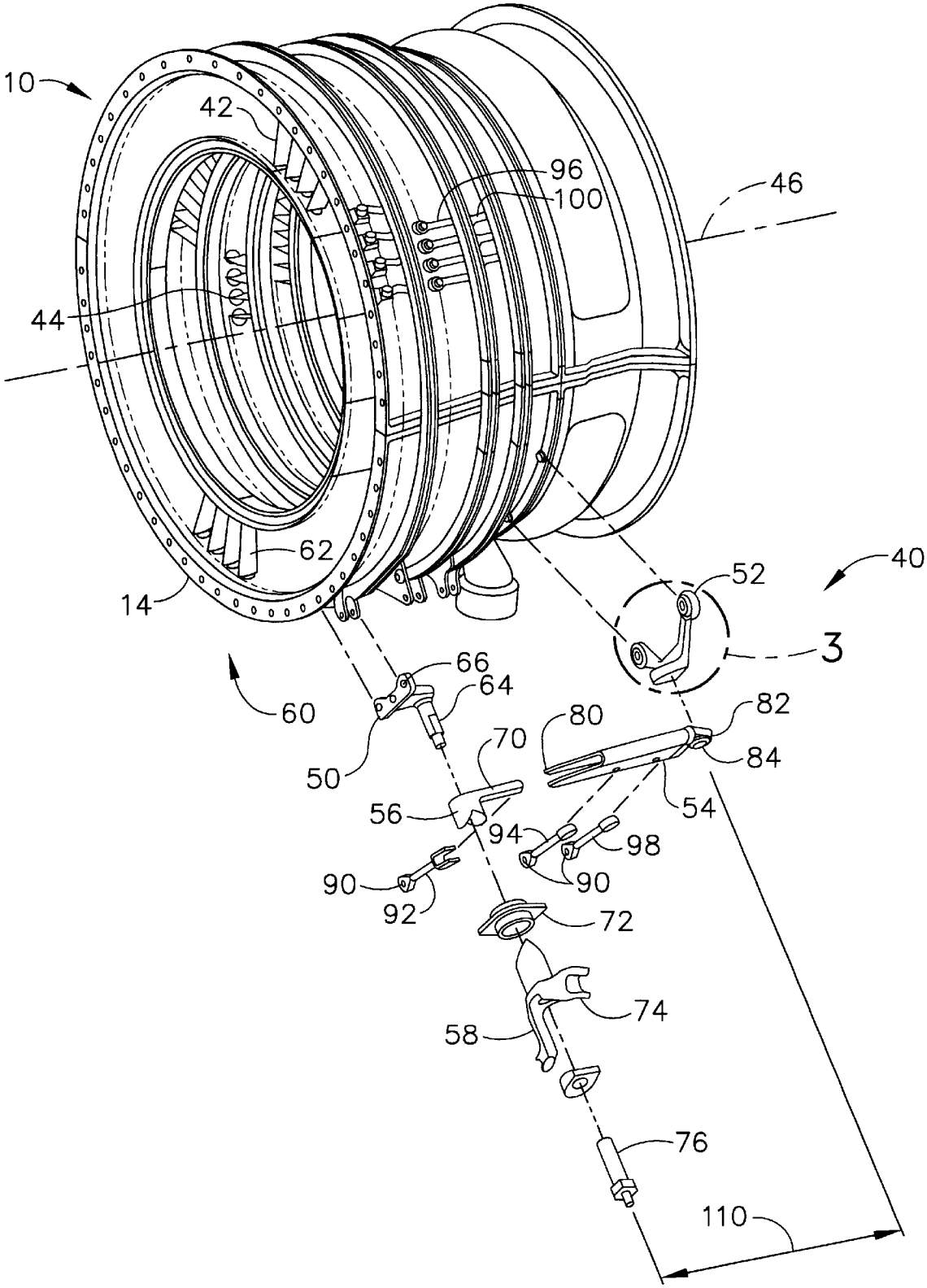
FIG. 2 is partial perspective view of the gas turbine engine shown in FIG. 1 including an exploded view of a variable geometry system.

FIG. 2 is partial perspective view of gas turbine engine 10 including compressor 14 and an exploded view of a variable geometry system 40. Compressor 14 is known in the art and includes a plurality of variable vanes 42 and a plurality of rotating non-variable vanes 44. Vanes 42 and 44 extend circumferentially around an engine central axis 46. More specifically, rotating vanes 44 rotate about central axis 46 between adjacent circumferential rows of variable vanes 42. Variable vanes 42 are adjustable to direct airflow onto rotating vanes 44 to facilitate optimizing engine performance while maintaining aerodynamic loading within mechanical limits of vanes 42. Vanes 42 also facilitate engine 10 achieving efficiency and stall margin requirements.

Variable geometry system 40 includes a forward mount 50, an aft mount 52, a master lever 54, an inner bellcrank 56, and an outer bellcrank 58. Forward mount 50 is known in the art and is attached to gas turbine engine 10 adjacent an upstream side 60 of high pressure compressor 14. More specifically, forward mount 50 is fixedly attached to compressor 14 radially outwardly from compressor inlet guide vanes 62.

Forward mount 50 includes an extension 64 and a base 66. Base 66 attaches to compressor 14 such that extension 64 extends substantially radially outwardly from compressor 14. Inner bellcrank 56 is known in the art and includes an opening (not shown) sized to receive forward mount extension 64 therethrough. Inner bellcrank 56 also includes an extension arm 70 extending substantially perpendicularly and downstream from forward mount extension 64.

A spherical bearing 72 attaches to forward mount extension 64 and is rotatably coupled to forward mount extension 64 between inner bellcrank 56 and outer bellcrank 58. Outer bellcrank 58 is known in the art and includes an extension 74 coupled to an electronically controlled actuator (not shown). Outer bellcrank 58 is secured to forward mount 50 with a sleeve nut 76.

Master lever 54 is known in the art and has an upstream end 80 and a downstream end 82. Master lever upstream end 80 is coupled to inner bellcrank extension arm 70 and master lever downstream end 82 is coupled to aft mount 52. Master lever downstream end 82 includes an opening 84 used to couple master lever 54 with aft mount 52. Aft mount 52 is fixedly attached, as described in more detail below, to engine 10.

A plurality of links 90 extend between variable geometry system 40 and compressor variable vanes 42. More specifically, a first link 92 is coupled between inner bellcrank extension arm 70 and compressor inlet guide vanes 62, a second link 94 is coupled between master lever 54 and a second row 96 of variable vanes 42, and a third link 98 is coupled between master lever 54 and a third row 100 of variable vanes 42. In one embodiment, variable vanes second row 96 are known as SI vanes, and variable vanes third row 100 are known as S2 vanes.

In use, the electronically controlled actuator positions outer bellcrank 58 to schedule variable vanes 42. More specifically, the actuator moves linearly in a direction that is substantially parallel to engine central axis 46. As the actuator is moved axially upstream, because outer bellcrank extension 74 is coupled to the actuator, outer bellcrank extension 74 rotates to translate the linear motion of the actuator to an angular displacement.

Because inner bellcrank 56 is coupled to outer bellcrank 58, as outer bellcrank 58 rotates, inner bellcrank 56 rotates proportionally with outer bellcrank 58. More specifically, inner bellcrank extension arm 70 rotates in proportion to the rotation of inner bellcrank 56. Thus, as inner bellcrank 56 rotates, the angular displacement of outer bellcrank 58 is translated into linear displacements through outer bellcrank extension arm 74.

The rotational movement of inner bellcrank extension arm 70 causes first link 92 to rotate compressor inlet guide vanes 62. Furthermore, as inner bellcrank 56 rotates, the angular displacement of outer bellcrank 58 is translated into linear displacements within master lever 54. More specifically, as inner bellcrank 56 rotates, master lever 54 articulates in a travel direction (not shown) substantially parallel to a travel direction (not shown) of inner bellcrank extension arm 70. Furthermore, as master lever 54 articulates, a distance 110 between master lever downstream end 82 and inner bellcrank 56 is decreased, and links 94 and 98 cause rotation of S1 variable vanes 96 and S2 variable vanes 100, respectively.

Figure 3:
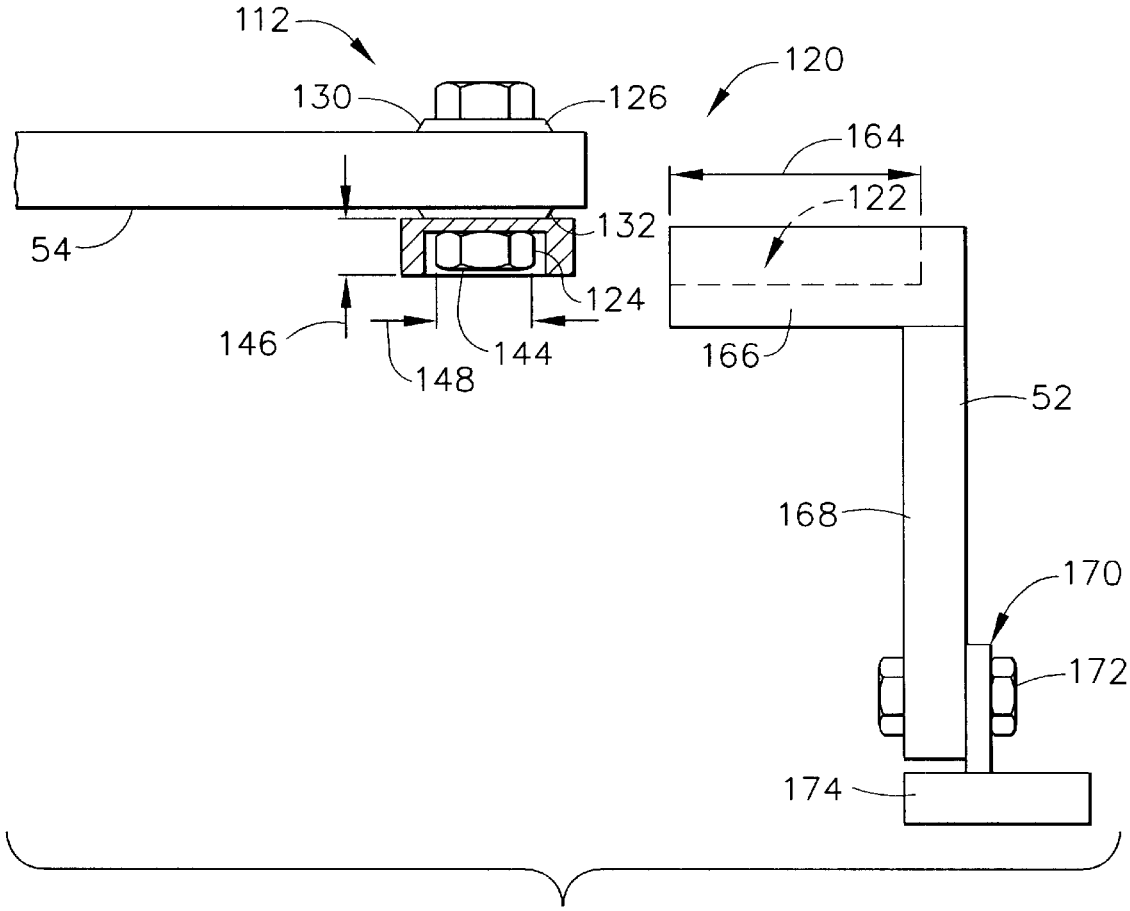
FIG. 3 is a side view of a portion of the variable geometry system shown in FIG. 2 taken along area 3.
Figure 4:
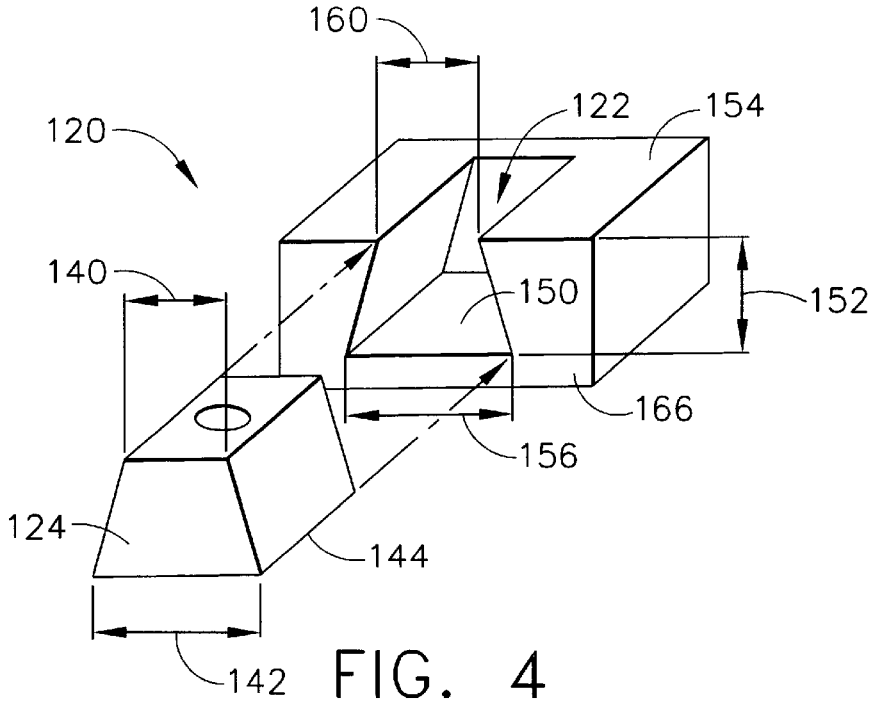
FIG. 4 is a perspective view of a slot and groove joint used with the variable geometry system shown in FIG. 3.

FIG. 3 is a side view of a portion 112 of variable geometry system 40 taken along area 3 shown in FIG. 2. FIG. 4 is a perspective view of a slot and groove joint 120 used with variable geometry system 40. More specifically, slot and groove joint 120 couples variable geometry system master lever 54 to aft mount 52. Slot and groove joint 120 includes a slot 122 and a mating projection 124.

Master lever 54 is coupled to slot and groove joint 120 with a bearing 126. In the exemplary embodiment, bearing 126 is a spherical bearing. In an alternative embodiment, bearing 126 is a metallic sleeve bearing. Bearing 126 extends through master lever downstream end opening 84 (shown in FIG. 2) and includes a radially outer side 130 and a radially inner side 132. Mating projection 124 is attached to bearing radially inner side 132.

Projection 124 is frusto-conical and has a first width 140 adjacent master lever 54 and a second width 142 adjacent a base 144 of projection 124. In one embodiment, projection widths 140 and 142 are configured such that projection 124 has a substantially dovetail cross-sectional profile. In a second embodiment, projection 124 has a substantially cylindrical cross-sectional profile. Projection base 144 is a distance 146 from bearing 126 and has a length 148.

Aft mount slot 122 is sized to receive projection 124 and has a defined cross-sectional profile that is substantially identical that of projection 124. Accordingly, a base 150 of slot 122 is a distance 152 from a top surface 154 of aft mount 52. Slot base distance 152 is approximately equal projection base distance 146. Furthermore, slot base 150 has a width 156 that is slightly larger than projection base width 142. Additionally, slot 122 has a width 160 adjacent aft mount top surface 154 that is slightly more than projection width 140. Accordingly, projection 124 is received within aft mount slot 122 in slidable contact. In one embodiment, slot 122 is coated with a wear-resistant coating. In a second embodiment, projection 124 is coated with a wear-resistant coating. Alternatively, projection 124 and slot 122 are both coated with a wear-resistant coating. Slot 122 has a length 164 extending within an aft mount arm 166 that is longer than projection length 148. both coated with a wear-resistant coating. Slot 122 has a length 164 extending within an aft mount arm 166 that is longer than projection length 148.

Aft mount arm 166 extends substantially perpendicularly and upstream from a pair of aft mount legs 168. Aft mount legs 168 are coupled between engine 10 (shown in FIGS. 1 and 2) and aft mount arm 166. More specifically, aft mount legs 168 are coupled between aft mount arm 166 and a pair of mounting lugs 170. Mounting lugs 170 fixedly secure aft mount 52 to engine 10 and each includes a fastener 172 and a mounting flange 174. Fasteners 172 extend through each mounting flange 174 and each respective aft mount leg 168.

In use, as variable geometry system 40 is activated and inner bellcrank 56 (shown in FIG. 2) is rotated, master lever 54 is repositioned such that a distance 110 between master lever downstream end 82 and inner bellcrank 56 is decreased. Because master lever downstream end 82 is coupled to aft mount arm 166, projection 124 is translated linearly within slot 122 towards inner bellcrank 56. Because mounting lugs 170 fixedly secure aft mount 52 to engine 10, angular displacement of aft mount 52 is eliminated. More specifically, slot and groove joint 120 permits master lever 54 to move planarly forward and aft, relative to aft mount 52, in two-dimensional planar motion without aft mount 52 moving angularly in response to movement of master lever 54. As a result, a decrease in wear between master lever 54 and aft mount 52 is facilitated.

The above-described variable geometry system is cost-effective and highly reliable. The variable geometry system includes a slot and groove joint that couples the aft mount to the master lever. The slot and groove joint enables the master lever to move in a two-dimensional plane without causing angular displacement of the aft mount. The slot and groove joint facilitates a reduction in wear between the aft mount and the master lever. As a result, the slot and groove facilitates extending a useful life of the variable geometry system in a cost-effective and reliable manner.

While the invention has been described in terms of various specific embodiments, those skilled in the art will recognize that the invention can be practiced with modification within the spirit and scope of the claims.

What is claimed is:

1. A method for assembling a variable geometry system for a gas turbine engine including a high pressure compressor, the variable geometry system including a master lever and at least one aft mount, the high pressure compressor including a plurality of variable vanes, said method comprising the steps of:

coupling the master lever to the aft mount using a slot and groove joint, to adjust the position of the high pressure compressor variable vanes during activation of the variable geometry system; and securing the aft mount to the gas turbine engine with a mounting lug that prevents angular displacement of the aft mount during activation of the variable geometry system.

2. A method in accordance with claim 1 wherein said step of coupling the master lever to the aft mount further comprises the step of coupling the master lever to the slot and groove joint with a sleeve bearing.

3. A method in accordance with claim 1 wherein said step of coupling the master lever to the aft mount further comprises the step of coupling the master lever to the slot and groove joint with a spherical bearing.

4. A method in accordance with claim 1 wherein said step of coupling the master lever to the aft mount further comprises the step of using a slot and groove joint having at least one of a dovetail-shaped groove and a substantially cylindrical-shaped groove.

5. A variable geometry system for a gas turbine engine, said variable geometry system comprising:

a master lever; and an aft mount, said master lever coupled to said aft mount with a slot and groove joint, and configured to adjust a position of variable vanes during activation of said variable geometry system, said aft mount comprising at least one mounting lug securing said aft mount to the gas turbine engine, said mounting lug configured to prevent angular displacement of said aft mount during activation of said variable geometry system.

6. A variable geometry system in accordance with claim 5 wherein said master lever coupled to said slot and groove joint with a spherical bearing.

7. A variable geometry system in accordance with claim 5 wherein said master lever coupled to said slot and groove joint with a sleeve bearing.

8. A variable geometry system in accordance with claim 5 wherein said slot and groove joint configured to restrict movement of said master lever to two-dimensional planar motion.

9. A variable geometry system in accordance with claim 5 wherein said slot and groove joint is coated with a wear resistant material.

10. A variable geometry system in accordance with claim 5 wherein said slot and groove joint comprises a substantially cylindrical-shaped groove.

11. A variable geometry system in accordance with claim 5 wherein said slot and groove joint comprises a dovetail-shaped groove.

12. A gas turbine engine comprising:

a high pressure compressor comprising a plurality of variable vanes; and a variable geometry system configured to re-direct airflow through said high pressure compressor, said variable geometry system comprising a master lever and an aft mount, said master lever coupled to said aft mount and configured to adjust a position of variable vanes during activation of said variable geometry system, said aft mount coupled to said master lever with a slot and groove joint.

13. A gas turbine engine in accordance with claim 12 wherein said variable geometry system further comprises at least one mounting lug securing said aft mount to said gas turbine engine, said mounting lug configured to prevent angular displacement of said aft mount during activation of said variable geometry system.

14. A gas turbine engine in accordance with claim 12 wherein said variable geometry system master lever coupled to said slot and groove joint with at least one of a spherical bearing and a sleeve bearing.

15. A gas turbine engine in accordance with claim 12 wherein said variable geometry system slot and groove joint configured to restrict movement of said master lever to two-dimensional planar motion.

16. A gas turbine engine in accordance with claim 12 wherein said variable geometry slot and groove joint comprises a dovetail-shaped groove.

17. A gas turbine engine in accordance with claim 12 wherein said variable geometry slot and groove joint comprises a substantially cylindrical-shaped groove.

18. A gas turbine engine in accordance with claim 12 wherein the slot and groove joint is coated with a wear resistant material.

* * * * *